US010283941B2

(12) United States Patent
Igarashi

(10) Patent No.: US 10,283,941 B2
(45) Date of Patent: May 7, 2019

(54) SPARK PLUG

(71) Applicant: NGK SPARK PLUG CO., LTD., Nagoya-shi, Aichi (JP)

(72) Inventor: Tomoyuki Igarashi, Kasugai (JP)

(73) Assignee: NGK SPARK PLUG CO., LTD., Nagoya-shi, Aichi (JP)

( * ) Notice: Subject to any disclaimer, the term of this patent is extended or adjusted under 35 U.S.C. 154(b) by 0 days.

(21) Appl. No.: 15/773,009

(22) PCT Filed: Oct. 11, 2016

(86) PCT No.: PCT/JP2016/004540
§ 371 (c)(1),
(2) Date: May 2, 2018

(87) PCT Pub. No.: WO2017/077688
PCT Pub. Date: May 11, 2017

(65) Prior Publication Data

US 2018/0323584 A1 Nov. 8, 2018

(30) Foreign Application Priority Data

Nov. 6, 2015 (JP) ..... 2015-218981

(51) Int. Cl.
*H01T 13/20* (2006.01)
*H01T 13/34* (2006.01)
(Continued)

(52) U.S. Cl.
CPC ..... *H01T 13/39* (2013.01); *H01T 13/20* (2013.01); *H01T 13/32* (2013.01); *H01T 13/34* (2013.01); *H01T 13/38* (2013.01)

(58) Field of Classification Search
USPC ..... 123/169 EL
See application file for complete search history.

(56) References Cited

U.S. PATENT DOCUMENTS

2006/0276097 A1* 12/2006 Suzuki ..... H01T 21/02 445/7
2013/0069516 A1* 3/2013 Sumoyama ..... C22C 5/04 313/141
2014/0152170 A1 6/2014 Kasuya et al.

FOREIGN PATENT DOCUMENTS

JP 2013-33670 A 2/2013
WO WO 2009-063914 A1 3/2011

OTHER PUBLICATIONS

International Search Report from corresponding International Patent Application No. PCT/JP16/04540, dated Jan. 10, 2017.

* cited by examiner

*Primary Examiner* — Ashok Patel
(74) *Attorney, Agent, or Firm* — Kusner and Jaffe

(57) ABSTRACT

An electrode of the spark plug includes a first melt portion formed between a body portion of an intermediate member and a noble metal tip; and a second melt portion that is formed, between a flange portion of the intermediate member and an electrode base material, at least at a position of intersection with an axial line of the noble metal tip. In a cross section including the axial line of the noble metal tip, when: a diameter of the noble metal tip is denoted by Tw; the shortest distance between the second melt portion and a boundary between the first melt portion and the intermediate member is denoted by S1; and the longest distance between the second melt portion and the boundary between the first melt portion and the intermediate member is denoted by S2, 1.0 mm≤Tw≤1.2 mm and (S2−S1)≤0.3 mm are met.

4 Claims, 5 Drawing Sheets

(51) Int. Cl.

| | |
|---|---|
| ***H01T 13/32*** | (2006.01) |
| ***H01T 13/38*** | (2006.01) |
| ***H01T 13/39*** | (2006.01) |

MODIFIED EMBODIMENTS

SPARK PLUG

RELATED APPLICATIONS

This application is a National Stage of International Application No. PCT/JP16/04540 filed Oct. 11, 2016, which claims the benefit of Japanese Patent Application No. 2015-218981, filed Nov. 6, 2015, the entire contents of which are incorporated herein by reference.

FIELD OF THE INVENTION

The present invention relates to a spark plug for igniting combustion gas in an internal combustion engine.

BACKGROUND OF THE INVENTION

In a spark plug for igniting combustion gas in an internal combustion engine, a gap for discharging a spark is formed between a center electrode and a ground electrode. Here, a spark plug is known in which a noble metal tip is mounted, via an intermediate member, to an electrode base material of the ground electrode (e.g., Japanese Patent Application Laid-Open (kokai) No. 2013-33670). The intermediate member is used for reducing a possibility of occurrence of a trouble when a noble metal tip is directly mounted on an electrode base material. For example, the amount of use of a noble metal tip can be reduced by interposing the intermediate member.

In the technique of Japanese Patent Application Laid-Open (kokai) No. 2013-33670, joining strength between the electrode base material and the intermediate member is improved by defining, when the intermediate member is joined to the electrode base material by welding, a relationship among a dimension of a nugget formed between the intermediate member and the electrode base material, a height from an arrangement surface of the electrode base material to an end surface of the noble metal tip, and the maximum width of the noble metal tip.

Incidentally, the diameter of a noble metal tip needs to be increased from the viewpoint of improvement in wear resistance. In the case where the diameter of a noble metal tip is increased, when the noble metal tip and the intermediate member are joined to each other by laser welding, stress applied to a melt portion formed between the noble metal tip and the intermediate member is likely to be large. Thus, it may be difficult to ensure joining strength between the noble metal tip and the intermediate member. Therefore, a technique is desired which allows improvement of not only joining strength between the electrode base material and the intermediate member but also joining strength between the noble metal tip and the intermediate member.

The present specification discloses a technique that allows improvement of joining strength between the noble metal tip and the intermediate member while wear resistance of a spark plug is improved.

SUMMARY OF THE INVENTION

The technique disclosed in the present specification can be embodied in the following application examples.

Application Example 1

In accordance with a first aspect of the present invention, there is provided spark plug comprising a center electrode and a ground electrode, at least one electrode of the center electrode and the ground electrode including:

an electrode base material;

a noble metal tip having a discharge surface that forms a gap between the noble metal tip and the other electrode;

an intermediate member that is disposed between the electrode base material and the noble metal tip, the intermediate member including a body portion located at the noble metal tip side and a flange portion having a larger diameter than the body portion and located at the electrode base material side;

a first melt portion that is formed between the body portion of the intermediate member and the noble metal tip; and a second melt portion that is formed, between the flange portion of the intermediate member and the electrode base material, at least at a position of intersection with an axial line of the noble metal tip, wherein in a cross section including the axial line of the noble metal tip, when: a diameter of the noble metal tip is denoted by Tw;

the shortest distance between the second melt portion and a boundary between the first melt portion and the intermediate member is denoted by S1; and the longest distance between the second melt portion and the boundary between the first melt portion and the intermediate member is denoted by S2, $1.0\ \text{mm} \le Tw \le 1.2\ \text{mm}$ and $(S2-S1) \le 0.3\ \text{mm}$ are met.

According to the above structure, a difference (S2−S1) between the longest distance S2 and the shortest distance S1 meets $(S2-S1) \le 0.3$ mm. Thus, in the case where a diameter Tw of the noble metal tip is relatively large, specifically, even if the diameter Tw of the noble metal tip is $1.0\ \text{mm} \le Tw \le 1.2\ \text{mm}$, local stress applied to the first melt portion when the intermediate member and the electrode base material are welded to each other can be suppressed. Therefore, while wear resistance is improved by an increase in the diameter Tw of the noble metal tip, occurrence of crack in the first melt portion when the intermediate member and the electrode base material are welded to each other can be suppressed, whereby joining strength between the noble metal tip and the intermediate member can be improved.

Application Example 2

In accordance with a second aspect of the present invention, there is provided a spark plug according to the application example 1, wherein, $0.2\ \text{mm} \le S1 \le 0.4\ \text{mm}$ is met.

According to the above structure, since the shortest distance S1 is not less than 0.2 mm, stress applied by moment to the first melt portion at the time of resistance welding can be suppressed. Since the shortest distance S1 is not more than 0.4 mm, a difference in temperature when the noble metal tip and the intermediate member are welded to each other can be suppressed, and thermal stress applied to the first melt portion can be suppressed. Thus, occurrence of cracks in the first melt portion when the intermediate member and the electrode base material are welded to each other can be more effectively suppressed. Therefore, joining strength between the noble metal tip and the intermediate member can be further improved.

Application Example 3

In accordance with a third aspect of the present invention, there is provided a spark plug according to the application example 1 or 2, wherein wherein in the cross section, when: the shortest distance between the second melt portion and a boundary between the first melt portion and the noble metal tip is denoted by T1; and the longest distance between the second melt portion and the boundary between the first melt portion and the noble metal tip is denoted by T2, $\{(T2-T1)-(S2-S1)\} \leq 0.4$ mm is met.

As $\{(T2-T1)-(S2-S1)\}$ is decreased, local stress applied to the first melt portion can be suppressed. According to the above structure, when $\{(T2-T1)-(S2-S1)\}$ is not more than 0.4 mm, local stress applied to the second melt portion can be suppressed. Thus, occurrence of cracks in the second melt portion when the intermediate member and the electrode base material are welded to each other can be further suppressed. Therefore, joining strength between the noble metal tip and the intermediate member can be further improved.

Application Example 4

In accordance with a fourth aspect of the present invention, there is provided a spark plug according to any one of application examples 1 to 3, wherein the electrode base material and the noble metal tip are a base material and a tip of the ground electrode.

According to the above structure, since temperature is likely to become high due to the vicinity of the center portion of a combustion chamber, joining strength between the noble metal tip and the intermediate member can be improved in the ground electrode required to have joining strength between the noble metal tip and the intermediate member.

The present invention can be embodied in various forms. For example, the present invention may be embodied in modes such as a spark plug, an electrode for the spark plug, an internal combustion engine equipped with the spark plug, an ignition device using the spark plug, and an internal combustion engine equipped with the ignition device.

DETAILED DESCRIPTION OF THE INVENTION

A. Embodiment

A-1. Structure of Spark Plug

Figure 1:
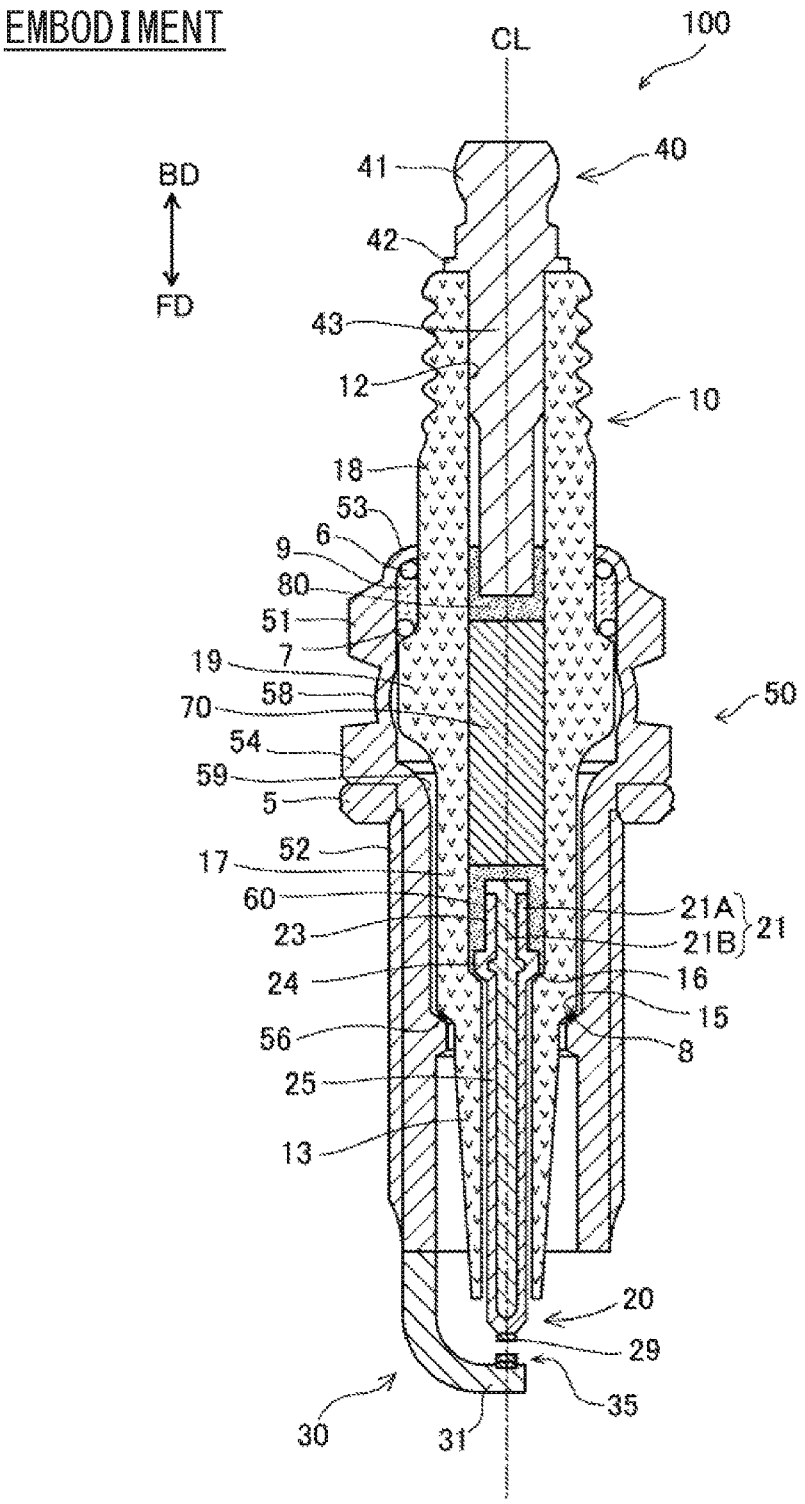
FIG. 1 is a cross-sectional view of a spark plug 100 according to the present embodiment.

Hereinafter, a mode of the present invention will be described on the basis of an embodiment. FIG. 1 is a cross-sectional view of a spark plug 100 according to the present embodiment. The alternate long and short dash line shown in FIG. 1 represents an axial line CL of the spark plug 100. The direction parallel to the axial line CL (the up-down direction in FIG. 1) is also referred to as the axial direction. The radial direction of a circle located on a plane perpendicular to the axial line CL and centered on the axial line CL is also referred to merely as "radial direction", and the circumferential direction of the circle is referred to merely as "circumferential direction". The downward direction in FIG. 1 is also referred to as a front end direction FD, and the upward direction is also referred to as a rear end direction BD. The lower side in FIG. 1 is referred to as the front side of the spark plug 100, and the upper side in FIG. 1 is referred to as the rear side of the spark plug 100.

The spark plug 100 is mounted to an internal combustion engine, and is used for igniting combustion gas in a combustion chamber of the internal combustion engine. The spark plug 100 includes a ceramic insulator 10 as an insulator, a center electrode 20, a ground electrode 30, a metal terminal 40, and a metal shell 50.

The ceramic insulator 10 is formed from alumina or the like being sintered. The ceramic insulator 10 is a substantially cylindrical member having a through hole 12 (axial hole) that extends along the axial direction and that penetrates through the ceramic insulator 10. The ceramic insulator 10 includes a flange portion 19, a rear trunk portion 18, a front trunk portion 17, a step portion 15, and a leg portion 13. The rear trunk portion 18 is located at the rear side with respect to the flange portion 19, and has a smaller outer diameter than the flange portion 19. The front trunk portion 17 is located at the front side with respect to the flange portion 19, and has a smaller outer diameter than the flange portion 19. The leg portion 13 is located at the front side with respect to the front trunk portion 17, and has a smaller outer diameter than the front trunk portion 17. When the spark plug 100 is mounted to the internal combustion engine (not shown), the leg portion 13 is exposed to the combustion chamber thereof. The step portion 15 is formed between the leg portion 13 and the front trunk portion 17.

The metal shell 50 is a cylindrical metal member formed from a conductive metal material (e.g., a low-carbon steel material) for fixing the spark plug 100 to the engine head (not shown) of the internal combustion engine. The metal shell 50 has an insertion hole 59 that penetrates along the axial line CL. The metal shell 50 is disposed at the outer periphery of the ceramic insulator 10. That is, the ceramic insulator 10 is inserted and held in the insertion hole 59 of the metal shell 50. The front end of the ceramic insulator 10 projects toward the front side with respect to the front end of the metal shell 50. The rear end of the ceramic insulator 10 projects toward the rear side with respect to the rear end of the metal shell 50.

The metal shell 50 includes: a tool engagement portion 51 which has a hexagonal columnar shape and with which a spark plug wrench is to be engaged; a mounting screw portion 52 for mounting the spark plug to the internal combustion engine; and a flange-like seat portion 54 formed between the tool engagement portion 51 and the mounting screw portion 52. The nominal diameter of the mounting screw portion 52 is, for example, one of M8 (8 mm), M10, M12, M14, or M18.

An annular gasket 5 formed by a metal plate being bent is fitted between the mounting screw portion 52 and the seat portion 54 of the metal shell 50. When the spark plug 100 is mounted to the internal combustion engine, the gasket 5 seals the gap between the spark plug 100 and the internal combustion engine (engine head).

The metal shell 50 further includes: a thin crimp portion 53 provided to the rear side of the tool engagement portion 51; and a thin compressive deformation portion 58 provided between the seat portion 54 and the tool engagement portion 51. Annular ring members 6 and 7 are disposed in an annular region formed between the inner peripheral surface of the portion of the metal shell 50 that extends from the tool engagement portion 51 to the crimp portion 53, and the outer peripheral surface of the rear side trunk portion 18 of the ceramic insulator 10. The space between the two ring members 6 and 7 in the region is filled with powder of talc 9. The rear end of the crimp portion 53 is bent radially inward and fixed to the outer peripheral surface of the ceramic insulator 10. The compressive deformation portion 58 of the metal shell 50 compressively deforms by the crimp portion 53 being pressed toward the front side during manufacturing, the crimp portion 53 being fixed to the outer peripheral surface of the ceramic insulator 10. The ceramic insulator 10 is pressed within the metal shell 50 toward the front side via the ring members 6 and 7 and the talc 9 due to the compressive deformation of the compressive deformation portion 58. The step portion 15 of the ceramic insulator 10 (step portion at the ceramic insulator side) is pressed by a step portion 56 (step portion at the metal member side) formed on the inner periphery of the mounting screw portion 52 of the metal shell 50, via an annular plate packing 8 made of metal. As a result, the plate packing 8 prevents gas within the combustion chamber of the internal combustion engine from leaking to the outside through the gap between the metal shell 50 and the ceramic insulator 10.

The center electrode 20 includes: a bar-shaped center electrode body 21 extending in the axial direction; and a columnar center electrode tip 29 joined to the front end of the center electrode body 21. The center electrode body 21 is disposed inside the axial hole 12 and at the front portion of the ceramic insulator 10. The center electrode body 21 has a structure that includes an electrode base material 21A, and a core portion 21B embedded in the electrode base material 21A. The electrode base material 21A is formed from nickel (Ni) or an alloy containing nickel as a main component, for example. In the present embodiment, the electrode base material 21A is formed from NCF600. The core portion 21B is formed from copper having more excellent thermal conductivity than an alloy that forms the electrode base material 21A or an alloy containing copper as a main component. In the present embodiment, the core portion 21B is formed from copper.

The center electrode body 21 includes: a flange portion 24 (electrode flange portion) provided at a predetermined position in the axial direction; a head portion 23 (electrode head portion) which is a portion at the rear side with respect to the flange portion 24; and a leg portion 25 (electrode leg portion) which is a portion at the front side with respect to the flange portion 24. The flange portion 24 is supported by a step portion 16 of the ceramic insulator 10. A front end portion of the leg portion 25, that is, the front end of the center electrode body 21 projects frontward of the front end of the ceramic insulator 10. The center electrode tip 29 will be described below.

The ground electrode 30 includes a ground electrode base material 31 joined to the front end of the metal shell 50, and a projection portion 35 that projects, toward the center electrode tip 29, from a front surface 31S at the rear side of a front end portion 31A of the ground electrode base material 31. The ground electrode 30 will be described below.

The metal terminal 40 is a bar-shaped member extending in the axial direction. The metal terminal 40 is formed from a conductive metal material (e.g., low-carbon steel), and a metal layer (e.g., a Ni layer) for anticorrosion is formed on the surface of the metal terminal 40 by plating or the like. The metal terminal 40 includes: a flange portion 42 (terminal jaw portion) formed at a predetermined position in the axial direction; a cap mounting portion 41 located at the rear side with respect to the flange portion 42; and a leg portion 43 (terminal leg portion) located at the front side with respect to the flange portion 42. The cap mounting portion 41 of the metal terminal 40 is exposed at the rear side with respect to the ceramic insulator 10. The leg portion 43 of the metal terminal 40 is inserted in the axial hole 12 of the ceramic insulator 10. A plug cap to which a high-voltage cable (not shown) is connected is mounted to the cap mounting portion 41, and a high voltage for causing a spark discharge to occur is applied to the cap mounting portion 41.

In the through hole 12 of the ceramic insulator 10, a resistor 70 for reducing electric wave noise at the time of occurrence of a spark is disposed between the front end of the metal terminal 40 (the front end of the leg portion 43) and the rear end of the center electrode 20 (the rear end of the head portion 23). The resistor 70 is formed from, for example, a composition containing glass particles as a main component, ceramic particles other than glass, and a conductive material. A conductive seal 60 fills a gap between the resistor 70 and the center electrode 20 in the through hole 12. A conductive seal 80 fills a gap between the resistor 70 and the metal terminal 40. The conductive seals 60, 80 are each formed from a composition containing glass particles of a $B_2O_3$—$SiO_2$-based material or the like and metal particles (Cu, Fe, etc.).

Figure 2A:
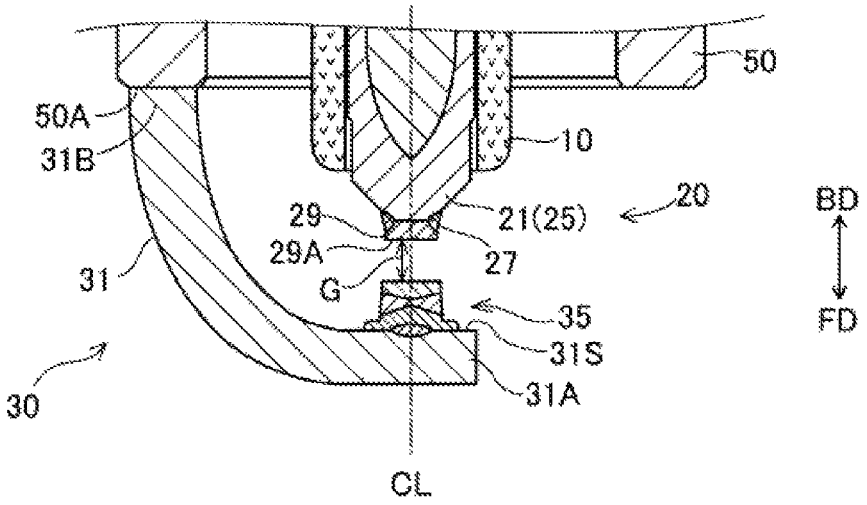
FIGS. 2(A) and 2(B) are a set of views illustrating the vicinity of the front end of the spark plug 100.
Figure 2B:
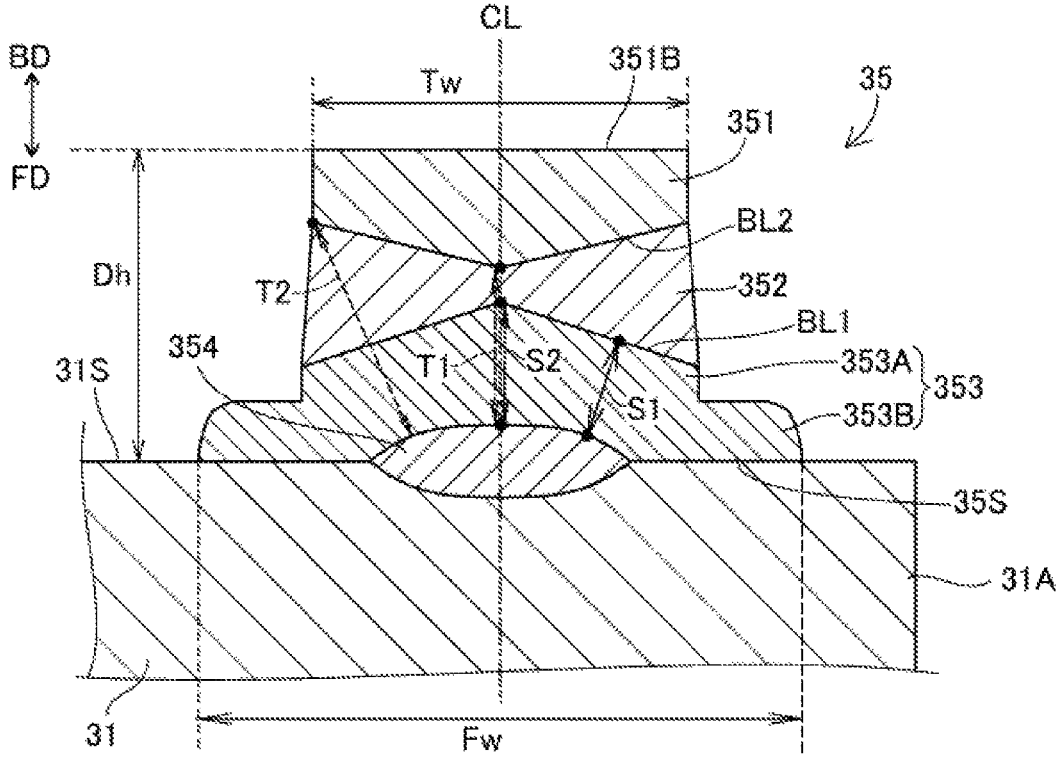

A-2. Structure of Front End Portion of Spark Plug 100:

A structure of the vicinity of the front end of the above-described spark plug 100 will be further described in detail. FIGS. 2(A) and 2(B) are a set of views illustrating the vicinity of the front end of the spark plug 100. FIG. 2(A) shows a cross section of the vicinity of the front end of the spark plug 100, obtained by cutting along a specific plane that includes the axial line CL. FIG. 2(B) shows an enlarged view of the vicinity of the projection portion 35 in the cross section of FIG. 2(A).

The center electrode tip 29 has a substantially columnar shape, and, for example, is joined to the front end of the center electrode body 21 (front end of the leg portion 25) by using laser welding, that is, via a melt portion 27 formed by laser welding (FIG. 2(A)). The melt portion 27 is a portion obtained by melting and solidifying the component of the center electrode tip 29 and the component of the center electrode body 21. The center electrode tip 29 is formed from a material containing, as a main component, a noble metal having a high melting temperature. The center electrode tip 29 is formed from platinum (Pt), for example. Alternatively, the center electrode tip 29 may be formed from iridium (Ir) or an alloy containing platinum or iridium as a main component.

The ground electrode base material 31 is a bent bar-shaped body having a quadrangular cross section. A rear end portion 31B of the ground electrode base material 31 is joined to a front end surface 50A of the metal shell 50. Accordingly, the metal shell 50 and the ground electrode base material 31 are electrically connected to each other. The front end portion 31A of the ground electrode base material 31 is a free end.

The ground electrode base material 31 is formed from a nickel alloy, for example, NCF601 or the like. The ground electrode base material 31 may include, embedded therein, a core material formed from a metal having a higher coefficient of thermal conductivity than a nickel alloy, such as copper or an alloy containing copper.

The projection portion 35 includes a noble metal tip 351, an intermediate member 353, and a first melt portion 352.

The noble metal tip 351 has a substantially columnar shape extending in the axial direction, and is formed from platinum. Alternatively, the noble metal tip 351 may be formed from iridium (Ir), or an alloy containing platinum or iridium as a main component. A rear end surface of the noble metal tip 351 is a discharge surface 351B that forms a gap G (spark gap) between the rear end surface of the noble metal tip 351 and a discharge surface 29A at the front side of the center electrode tip 29. The front end surface of the noble metal tip 351 is in contact with the first melt portion 352. The diameter of the noble metal tip 351 (the diameter of the discharge surface 351B) is denoted by Tw. As the diameter Tw of the noble metal tip 351 is increased, the volume of the noble metal tip 351 can be increased, whereby wear resistance of the spark plug 100 can be improved.

The intermediate member 353 includes a body portion 353A, and a flange portion 353B located at the front side with respect to the body portion 353A, that is, located at the ground electrode base material 31 side. The intermediate member 353 is formed from, for example, an alloy containing nickel as a main component, for example, an alloy obtained by adding aluminum (Al) or silicon (Si) to nickel. The body portion 353A has a substantially columnar shape extending in the axial direction. A rear end surface of the body portion 353A is in contact with the first melt portion 352. The diameter of the body portion 353A is substantially equal to the diameter Tw of the noble metal tip 351, that is, equal to the diameter Tw or a little larger than the diameter Tw. The flange portion 353B is a disc-shaped portion having an outer diameter Fw larger than the outer diameter of each of the body portion 353A and the noble metal tip 351. Therefore, the flange portion 353B includes a portion that projects radially outward of the outer peripheral surface of the body portion 353A at the front side with respect to the body portion 353A.

The first melt portion 352 is formed, by laser welding, between the noble metal tip 351 and the intermediate member 353. The first melt portion 352 is a portion obtained by melting and solidifying the component of the noble metal tip 351 and the component of the intermediate member 353. In other words, the noble metal tip 351 is joined, via the first melt portion 352, to the rear side of the body portion 353A of the intermediate member 353. In an example of FIG. 2(B), the first melt portion 352 is formed over the entire circumference of the projection portion 35, and is also formed at the position of intersection with the axial line CL.

A front end surface 35S of the projection portion 35, that is, the front end surface 35S of the flange portion 353B of the intermediate member 353, is joined, by resistance welding, to the front surface 31S of the front end portion 31A of the ground electrode base material 31. A second melt portion 354 is formed at least at the position of intersection with the axial line CL of the noble metal tip 351 between the front end surface 35S of the flange portion 353B and the front surface 31S of the ground electrode base material 31. The second melt portion 354 is a portion obtained by melting and solidifying, by resistance welding, the component of the intermediate member 353 and the component of the ground electrode base material 31. This portion is also referred to as a nugget.

The second melt portion 354 can have various sizes and shapes in accordance with a condition of resistance welding. The second melt portion 354 in FIG. 2(B) has a disc shape as a whole. The shape of the boundary surface between the second melt portion 354 and the intermediate member 353 is a bowl-like shape that protrudes to the rear side. The shape of a boundary surface between the second melt portion 354 and the ground electrode base material 31 is a bowl-like shape that protrudes to the front side.

As described above, when the noble metal tip 351 is fixed to the ground electrode base material 31 with the intermediate member 353 therebetween, a projection length Dh (FIG. 2(B)) of the projection portion 35 including the noble metal tip 351 can be lengthened without increasing the amount of use of the noble metal tip 351 formed from a relatively expensive material. When the projection length Dh is lengthened, it is possible to suppress prevention, by the ground electrode base material 31, of the expansion of combustion of combustion gas ignited by a spark that has occurred in the gap G. Thus, ignitability of the spark plug 100 can be improved.

Here, in the cross section of FIG. 2(B), the shortest distance between the second melt portion 354 and a boundary BL1 between the first melt portion 352 and the intermediate member 353 is denoted by S1, and the longest distance between the boundary BL1 and the second melt portion 354 is denoted by S2. The shortest distance S1 can be said to be a distance between the second melt portion 354 and a point, of the points on the boundary BL1, from which the distance to the second melt portion 354 is shortest. The longest distance S2 can be said to be a distance between the second melt portion 354 and a point, of the points on the boundary BL1, from which the distance to the second melt portion 354 is longest. In an example of FIG. 2(B), the point, of the points on the boundary BL1, from which the distance to the second melt portion 354 is shortest is a position located between the intersection point of the boundary BL1 and the axial line CL and the intersection point of the boundary BL1 and the outer peripheral surface of the projection portion 35. The point, of the points on the boundary BL1, from which the distance to the second melt portion 354 is longest is the intersection point of the boundary BL1 and the axial line CL.

In the cross section of FIG. 2(B), the shortest distance between the second melt portion 354 and a boundary BL2 between the first melt portion 352 and the noble metal tip 351 is denoted by T1, and the longest distance between the boundary BL2 and the second melt portion 354 is denoted by T2. The shortest distance T1 can be said to be a distance between the second melt portion 354 and a point from which the distance to the second melt portion 354, of the points on the boundary BL2, is shortest. The longest distance T2 can be said to be a distance between the second melt portion 354 and a point from which the distance to the second melt portion 354, of the points on the boundary BL2, is longest. In an example of FIG. 2(B), the point from which the distance to the second melt portion 354, of the points on the boundary BL2, is shortest is the intersection point of the boundary BL2 and the axial line CL. The point from which the distance to the second melt portion 354, of the point on the boundary BL2, is longest is the intersection point of the boundary BL2 and the outer peripheral surface of the projection portion 35.

A-3. Method for Manufacturing Ground Electrode 30

Figure 3A:
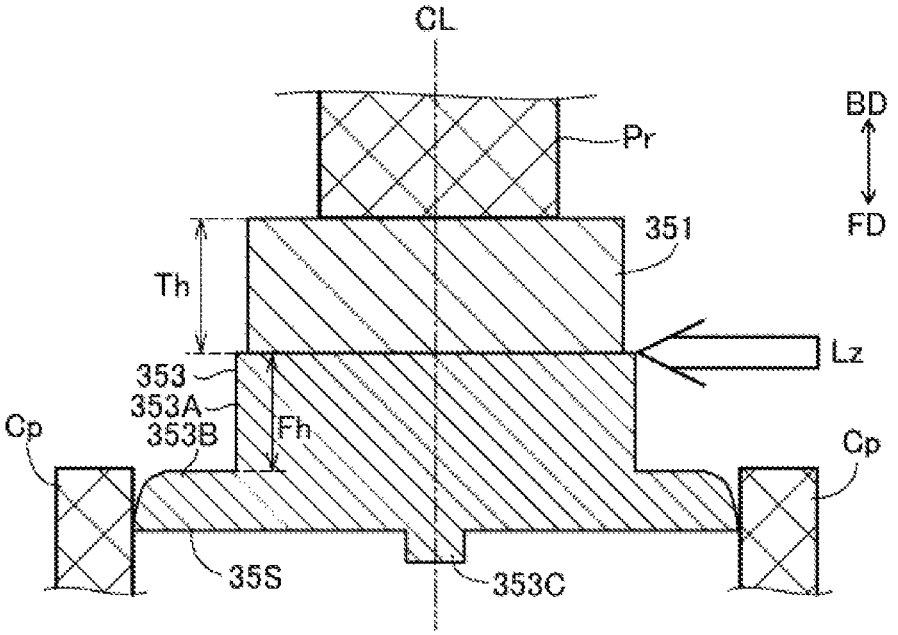
FIGS. 3(A) and 3(B) are a set of explanatory views illustrating a method for manufacturing a ground electrode 30.
Figure 3B:
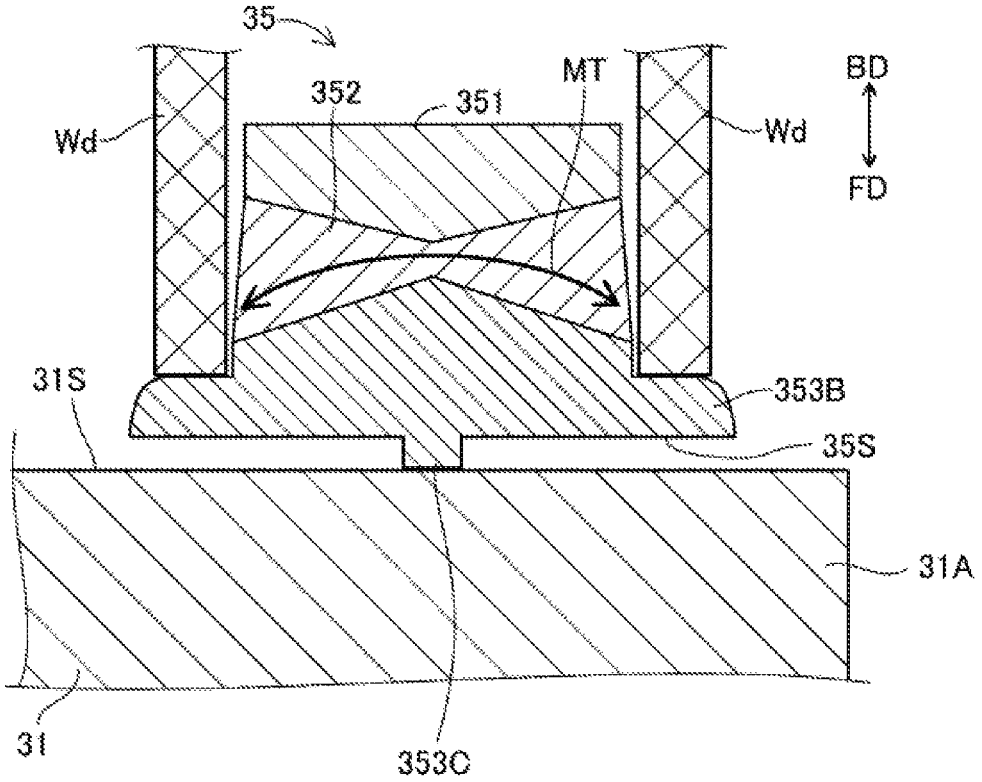

FIGS. 3(A) and 3(B) are a set of explanatory views illustrating a method for manufacturing the ground electrode 30. First, a manufacturer prepares the noble metal tip 351 having a columnar shape, which has not been welded yet, and the intermediate member 353 which has not been welded yet. The intermediate member 353 which has not been welded yet includes the body portion 353A having a columnar shape and extending along the axial line CL, the flange portion 353B disposed at the front side of the body portion 353A, and a protruding portion 353C. The protruding portion 353C is located at the intersection point of the axial line CL and the front end surface 35S of the intermediate member 353, and projects from the front end surface 35S to the front side.

The manufacturer joins the noble metal tip 351 to the intermediate member 353 by laser welding. First, as shown in FIG. 3(A), the flange portion 353B of the intermediate member 353 is fixed by a clamp Cp, and the noble metal tip 351 is disposed on the rear end surface of the body portion 353A of the intermediate member 353. In a state where the rear end surface of the noble metal tip 351 is pressed by a predetermined pressing member Pr, a laser Lz substantially perpendicular to the axial line CL is applied, from radially outward to radially inward, to a contact portion between the noble metal tip 351 and the body portion 353A. For example, the laser Lz is applied, by an irradiation device such as a fiber laser irradiation device, to a contact portion between the noble metal tip 351 and the body portion 353A. When the noble metal tip 351 and the body portion 353A relatively rotate, about the axial line CL, with respect to the irradiation device of the laser Lz, the laser Lz is applied to the entire circumference of a contact portion between the noble metal tip 351 and the body portion 353A. Therefore, the first melt portion 352 having a shape shown in FIG. 2(B) is formed, and the noble metal tip 351 and the body portion 353A are joined to each other.

At this time, the shape of the first melt portion 352 can be controlled by adjusting the conditions such as energy of the laser Lz, a light collecting position, a rotation speed of the noble metal tip 351 and the body portion 353A, and pressure by the pressing member Pr, and the like. For example, when the rotation speed is increased and the energy of the laser Lz is strengthened, the difference between the thickness, on the axial line CL, of the first melt portion 352 and the thickness on the outer peripheral surface of the first melt portion 352 can be made small.

Next, as shown in FIG. 3(B), the manufacturer fixes, by resistance welding, the intermediate member 353 (i.e., the projection portion 35) to which the noble metal tip 351 is joined, to the front surface 31S of the bar-shaped ground electrode base material 31. At this time, resistance welding is performed by applying a current for welding between the ground electrode base material 31 and the intermediate member 353 in a state where the surface at the rear side of the flange portion 353B is pressed by a cylindrical electrode Wd for welding. Since resistance welding is started from a state where the front surface 31S of the ground electrode base material 31 and the protruding portion 353C are in contact with each other, first, current is concentrated on the protruding portion 353C. Thus, the protruding portion 353C and a portion, of the ground electrode base material 31, which is in contact with the intermediate member 353 are melted, whereby the second melt portion 354 is formed. Then, when the front end surface 35S of the intermediate member 353 comes into contact with the front surface 31S of the ground electrode base material 31, resistance welding is performed between the ground electrode base material 31 and the front end surface 35S of the intermediate member 353. Thus, the ground electrode 30 is manufactured.

At this time, the size or shape of the second melt portion 354 can be controlled by adjusting the conditions of resistance welding such as the shape or size of the protruding portion 353C, the magnitude of the current in resistance welding, and pressure applied to the electrode Wd for welding. For example, as the length in the axial direction of the protruding portion 353C is increased, the length in the axial direction of the second melt portion 354 is increased. As the length in the direction perpendicular to the axial direction of the protruding portion 353C is increased, the length in the direction perpendicular to the axial direction of the second melt portion 354 is increased.

At the time of this resistance welding, when the flange portion 353B is pressed, as shown in FIG. 3(B), a moment MT centering the second melt portion 354 (the second melt portion 354 is formed at a position of the protruding portion 353C in FIG. 3(B)) is generated in the projection portion 35. The moment is, for example, a force that acts so as to bend the cross section, in the projection portion 35, perpendicular to the axial line CL in bowl-shape that protrudes to the rear side (the upper side of FIG. 3(B)). In the case where the diameter Tw of the noble metal tip 351 is relatively large, cracks are more likely to occur on the outer peripheral surface of the first melt portion 352 because of the moment MT.

Therefore, the spark plug 100 of the present embodiment is structured such that the diameter Tw of the noble metal tip is set to a relatively large value, specifically, to 1.0 mm≤Tw≤1.2 mm and the above-mentioned difference (S2−S1) between the longest distance S2 and the shortest distance S1 is not more than 0.3 mm. That is, the spark plug 100 of the present embodiment meets 1.0 mm≤Tw≤1.2 mm and (S2−S1)≤0.3 mm. Specifically, as the difference (S2−S1) between the longest distance S2 and the shortest distance S1 is decreased, variation of the moment MT in the boundary BL between the intermediate member 353 and the first melt portion 352 can be suppressed and the moment MT can be uniformed. Thus, even in a case where the diameter Tw of the noble metal tip is relatively large, specifically, 1.0 mm≤Tw≤1.2 mm, local stress applied to the first melt portion 352 when the intermediate member 353 and the ground electrode base material 31 are welded to each other can be suppressed, and bending due to the moment MT in the boundary BL1 between the intermediate member 353 and the first melt portion 352 can be suppressed. Therefore, while wear resistance is improved by an increase in the diameter Tw of the noble metal tip 351, occurrence of cracks in the first melt portion 352 can be suppressed when the intermediate member 353 and the ground electrode base material 31 are welded to each other, whereby joining strength between the noble metal tip 351 and the intermediate member 353 can be improved.

Further, the shortest distance S1 preferably meets 0.2 mm≤S1≤0.4 mm. As the shortest distance S is decreased, since the radius of curvature of bending by the moment MT is decreased, in particular, stress applied to the outer peripheral surface of the first melt portion 352 is likely to be large. Thus, when the shortest distance S1 is less than 0.2 mm, crack is likely to occur in the first melt portion 352. In addition, as compared with the noble metal tip 351, the intermediate member 353 that is a nickel alloy has a low coefficient of thermal conductivity (that is, heat conduction is poor). Thus, when the shortest distance S1 exceeds 0.4 mm, heat generated by resistance welding is confined in the intermediate member 353, whereby the temperature of the intermediate member 353 is likely to be high. In contrast, since the noble metal tip 351 has a high coefficient of thermal conductivity, the temperature of the noble metal tip 351 is not as high as that of the intermediate member 353. Thus, cracks are likely to occur in the first melt portion 352 because of thermal stress caused by the difference in temperature between the noble metal tip 351 and the intermediate member 353. In the case where 0.2 mm≤S1≤0.4 mm is met, stress applied by the moment to the first melt portion 352 at the time of resistance welding can be suppressed, the difference in temperature at the time of resistance welding between the noble metal tip 351 and the first melt portion 352 can be suppressed, whereby thermal stress applied to the first melt portion 352 can be suppressed. As a result, occurrence of crack in the first melt portion 352 when the intermediate member and the electrode base material are welded to each other can be more effectively suppressed. Therefore, joining strength between the noble metal tip and the intermediate member can be further improved.

Further, the above-described shortest distance S1, longest distance S2, shortest distance T1, and longest distance T2 more preferably meet |(T2−T1)−(S2−S1)|≤0.4 mm. Similarly as in the boundary BL1 between the intermediate member 353 and the first melt portion 352, as the difference (T2−T1) between the longest distance T2 and the shortest distance T1 is decreased, variation in the moment MT also in the boundary BL2 between the noble metal tip 351 and the first melt portion 352 can be suppressed and the moment MT can be uniformed. Thus, as the difference (T2−T1) is decreased, bending by the moment MT in the boundary BL2 between the noble metal tip 351 and the first melt portion 352 can be suppressed. Therefore, as an absolute value |(T2−T1)−(S2−S1)| of the difference between (T2−T1) and (S2−S1) is decreased, a difference between bending by the moment MT in the boundary BL1 and bending by the moment MT in the boundary BL2 can be made small. As a result, stress applied to the first melt portion 352 by the moment MT can be further suppressed. Therefore, occurrence of crack in the first melt portion 352 when the intermediate member 353 and the ground electrode base material 31 are welded to each other can be further suppressed, whereby joining strength between the noble metal tip 351 and the intermediate member 353 can be further improved.

Further, as in the above-described embodiment, it is particularly preferable to meet the above-described relationship between S1 and S2, range of S1, and relationship among S1, S2, T1, and T2 in the ground electrode 30. Since the ground electrode 30 is located at the front side with respect to the center electrode 20 and is closer to the center portion of the combustion chamber, the temperature thereof is likely to be high. Thus, the ground electrode 30 is required to have joining strength between the noble metal tip and the intermediate member as compared with the center electrode 20. Therefore, in the above-described embodiment, in the ground electrode 30 required to have joining strength between the noble metal tip 351 and the intermediate member 353, joining strength between the noble metal tip 351 and the intermediate member 353 can be improved.

A-4. First Evaluation Test

Using samples of a spark plug, an evaluation test of joining strength between the noble metal tip 351 and the intermediate member 353 was conducted. In a first evaluation test, as indicated in Table 1, 66 kinds of samples different from each other in at least one of: the above-described difference (S2−S1) between the longest distance S2 and the shortest distance S1; and the diameter Tw of the noble metal tip 351 were used.

TABLE 1

| | | Tw (mm) | | | | | | | | | | |
|---|---|---|---|---|---|---|---|---|---|---|---|---|
| | | 0.8 | 0.85 | 0.9 | 0.95 | 1 | 1.05 | 1.1 | 1.15 | 1.2 | 1.25 | 1.3 |
| S2-S1 (mm) | Less than 0.1 | A | A | A | A | A | A | A | A | A | A | A |
| | 0.1 | A | A | A | A | A | A | A | A | A | A | A |
| | 0.2 | A | A | A | A | A | A | A | A | A | A | A |
| | 0.3 | A | A | A | A | A | A | A | A | A | B | B |
| | 0.4 | A | A | A | A | A | A | A | A | B | B | C |
| | 0.5 | A | A | A | A | A | A | A | B | B | C | C |

As indicated in Table 1, in the 66 kinds of samples, the difference (S2−S1) is one of less than 0.1 mm, 0.1 mm, 0.2 mm, 0.3 mm, 0.4 mm, or 0.5 mm. In addition, the diameter Tw of the noble metal tip 351 is one of 0.8 mm, 0.85 mm, 0.9 mm, 0.95 mm, 1 mm, 1.05 mm, 1.1 mm, 1.15 mm, 1.2 mm, 1.25 mm, or 1.3 mm.

The dimensions common to each sample are as follows.

Thickness Th (FIG. 3(A)) of the noble metal tip 351 for which laser welding has not been performed yet: 0.4 mm Thickness Th (FIG. 3(A)) of the body portion 353A of the intermediate member 353 for which laser welding has not been performed yet: 0.3 mm Projection length Dh (FIG. 2(B)) of the projection portion 35: 0.85 mm An examiner prepared the noble metal tip 351 having the diameter Tw in Table 1 and the intermediate member 353 having the body portion 353A having the diameter Tw, and produced, by changing a condition of laser welding, the ground electrodes 30 that include the projection portions 35 having various shapes of the first melt portion 352. The examiner measured the difference (S2−S1) at the cross section of the ground electrode 30, obtained by cutting along a plane including the axial line CL. Then, the examiner specified a condition of laser welding in which the difference (S2−S1) becomes a desired value, and produced samples using the condition.

In the first evaluation test, the surface of the first melt portion 352 of each sample was observed using a microscope and the presence or absence of cracks was checked. In the case where a crack was found, the length (depth) of the crack in the radial direction was measured at the cross section, of the ground electrode 30 of the sample, obtained by cutting along a plane passing through the center of the crack and including the axial line CL. A sample in which cracks were absent or the length of crack was less than 0.1 mm was evaluated as "A", a sample in which the length of crack was not less than 0.1 mm and not more than 0.15 mm was evaluated as "B", and a sample in which the length of crack was not less than 0.15 mm was evaluated as "C". In the order of A, B, C, joining strength between the noble metal tip 351 and the intermediate member 353 is excellent.

As indicated in Table 1, of samples in which the diameter Tw was not more than 1.1 mm, all samples in which the difference (S2−S1) was not more than 0.5 mm were evaluated as "A". Of samples in which the diameter Tw was 1.15 mm, samples in which the difference (S2−S1) was 0.5 mm was evaluated as "B", and samples in which the difference (S2−S1) was not more than 0.4 mm were evaluated as "A". Of samples in which the diameter Tw was 1.2 mm, samples in which the difference (S2−S1) was 0.4 mm or 0.5 mm were evaluated as "B", and samples in which the difference (S2−S1) was not more than 0.3 mm were evaluated as "A". Of samples in which the diameter Tw was 1.25 mm, samples in which the difference (S2−S1) was 0.5 mm were evaluated as "C", samples in which the difference (S2−S1) was 0.3 mm or 0.4 mm were evaluated as "B", and samples in which the difference (S2−S1) was not more than 0.2 mm were evaluated as "A". Of samples in which the diameter Tw was 1.3 mm, samples in which the difference (S2−S1) was 0.4 mm or 0.5 mm were evaluated as "C", samples in which the difference (S2−S1) was 0.3 mm were evaluated as "B", and samples in which the difference (S2−S1) was not more than 0.2 mm were evaluated as "A".

From the above results, it has been confirmed that (S2−S1)≤0.3 mm is preferably met at least in a range of 1.0 mm≤Tw≤1.2 mm. If so, occurrence of crack in the first melt portion 352 can be suppressed, and joining strength between the noble metal tip 351 and the intermediate member 353 can be improved.

In addition, it has been found that in a case where Tw is 1.25 mm or 1.3 mm, (S2−S1)≤0.2 mm is preferably met.

A-5. Second Evaluation Test

In a second evaluation test, as indicated in Table 2, the difference (S2−S1) between the longest distance S2 and the shortest distance S1 is fixed at 0.2 mm, and an evaluation was performed in a stricter manner. In the second evaluation test, 81 kinds of samples different from each other in at least one of: the diameter Tw of the noble metal tip 351; and the shortest distance S1 were used.

TABLE 2

| | | Tw (mm) | | | | | | | | |
|---|---|---|---|---|---|---|---|---|---|---|
| | | 0.8 | 0.85 | 0.9 | 0.95 | 1 | 1.05 | 1.1 | 1.15 | 1.2 |
| S1 (mm) | 0.1 | A | B | B | B | C | C | C | D | D |
| | 0.15 | A | A | B | B | C | C | C | C | C |
| | 0.2 | A | A | A | A | B | B | B | B | B |
| | 0.25 | A | A | A | A | A | B | B | B | B |
| | 0.3 | A | A | A | A | A | A | B | B | B |
| | 0.35 | A | A | A | A | B | B | B | B | B |
| | 0.4 | A | A | A | B | B | B | B | B | B |
| | 0.45 | A | A | B | B | C | C | C | C | C |
| | 0.5 | A | A | B | B | C | C | D | D | D |

As indicated in Table 2, in 81 kinds of samples, the shortest distance S1 is one of 0.1 mm, 0.15 mm, 0.2 mm, 0.25 mm, 0.3 mm, 0.35 mm, 0.4 mm, 0.45 mm, and 0.5 mm. In addition, the diameter Tw of the noble metal tip 351 is one of 0.8 mm, 0.85 mm, 0.9 mm, 0.95 mm, 1 mm, 1.05 mm, 1.1 mm, 1.15 mm, or 1.2 mm.

The shortest distance S1 was changed by adjusting the thickness Th of the noble metal tip 351 for which laser welding has not been performed yet, and the thickness Th of the body portion 353A of the intermediate member 353 for which laser welding has not been performed yet.

In the second evaluation test, similarly as in the first evaluation test, for each of the samples, the presence or absence of cracks and the length (depth) of cracks in the radial direction were measured. Samples in which cracks were absent were evaluated as "A", samples in which the length of the crack was less than 0.01 mm were evaluated as "B", samples in which the length of the crack was not less than 0.01 mm and not more than 0.05 mm were evaluated as "C", and samples in which the length of crack was not less than 0.05 mm were evaluated as "D". In the order of A, B, C, D, joining strength between the noble metal tip 351 and the intermediate member 353 is excellent.

As indicated in Table 2, of samples in which the diameter Tw was less than 1.0 mm, regardless of the value of the shortest distance S1, all samples were evaluated as "B" or better. This may be because in samples in which the diameter Tw is less than 1.0 mm, the degree of bending by the above-described moment MT is relatively small.

Of samples in which the diameter Tw was not less than 1.0 mm and less than 1.2 mm, samples in which the value of the shortest distance S1 was less than 0.2 mm, that is, samples in which the value of the shortest distance S1 was 0.1 mm or 0.15 mm, were evaluated as "C" or worse. In addition, of samples in which the diameter Tw was not less than 1.0 mm and less than 1.2 mm, samples in which the value of the shortest distance S1 exceeds 0.4 mm, that is, samples in which the value of the shortest distance S1 was 0.45 mm or 0.5 mm, were evaluated as "C" or worse.

On the other hand, of samples in which the diameter Tw was not less than 1.0 mm and less than 1.2 mm, samples in which the value of the shortest distance S1 was not less than 0.2 mm and not more than 0.4 mm were evaluated as "B" or better. As described above, it has been confirmed that 0.2 mm≤S1≤0.4 mm is more preferably met in the spark plug 100.

Further, a close look revealed that of samples in which the diameter Tw was 1 mm, samples in which the shortest distance S1 was 0.25 mm or 0.3 mm were evaluated as "A". Thus, it has been found that in the case where the diameter Tw is 1.0 mm, the shortest distance S1 is particularly preferably 0.25 mm or 0.3 mm. In addition, of samples in which the diameter Tw was 1.05 mm, samples in which the shortest distance S1 was 0.3 mm were evaluated as "A". Therefore, it has been found that in the case where the diameter Tw is 1.05 mm, the shortest distance S1 is particularly preferably 0.3 mm.

A-6. Third Evaluation Test

In a third evaluation test, the following sample groups were prepared and an evaluation was performed in a stricter manner.

Sample group A1: Tw=1.0 mm, S1=0.3 mm, (S2−S1)=0.3 mm

Sample group A2: Tw=1.0 mm, S1=0.3 mm, (S2−S1)=0.1 mm

Sample group B1: Tw=1.1 mm, S1=0.4 mm, (S2−S1)=0.3 mm

Sample group B2: Tw=1.1 mm, S1=0.4 mm, (S2−S1)=0.25 mm

Sample group C1: Tw=1.2 mm, S1=0.2 mm, (S2−S1)=0.3 mm

Sample group C2: Tw=1.2 mm, S1=0.2 mm, (S2−S1)=0.05 mm

For each of the sample groups, five samples in which the above-described values of |(T2−T1)−(S2−S1)| were 0.1 mm, 0.2 mm, 0.3 mm, 0.4 mm, and 0.5 mm, respectively, were prepared. These samples were prepared by producing, while finely changing a condition of laser welding, the ground electrodes 30 including the projection portions 35 having various shapes of the first melt portions 352.

In the third evaluation test, a thermal cyclic test was conducted in which a cycle of heating and cooling of the vicinity of the front end portion of a sample (the vicinity of the noble metal tip 351) was repeated 3000 times. In one cycle, the vicinity of the front end portion of each sample was heated by a burner for two minutes, and subsequently was cooled in the atmosphere for two minutes. Measurement was performed using a radiation thermometer such that the temperature of the discharge surface 351B of the noble metal tip 351 reaches 1000° C. that is the target temperature, by heating for two minutes, and the strength of the burner was adjusted on the basis of the measurement result.

After the thermal cyclic test, the ground electrode 30 of each sample was cut along the cross section including the axial line CL, and the occurrence rate of oxide scale in the cross section was measured. Specifically, a portion in which oxide scale occurred was specified in each of the boundary BL1 between the first melt portion 352 and the intermediate member 353 and the boundary BL2 between the noble metal tip 351 and the first melt portion 352 as shown in FIG. 2(B). In these boundaries, oxide scale did not occur at a portion in which joining is kept, and oxide scale occurred at a portion in which peeling occurs. Then, the proportion of the portion in which oxide scale occurs to the total length of the boundary was calculated as the occurrence rate of oxide scale. As the occurrence rate of oxide scale is low, joining strength between the noble metal tip 351 and the intermediate member 353 became more excellent.

Figure 4A:
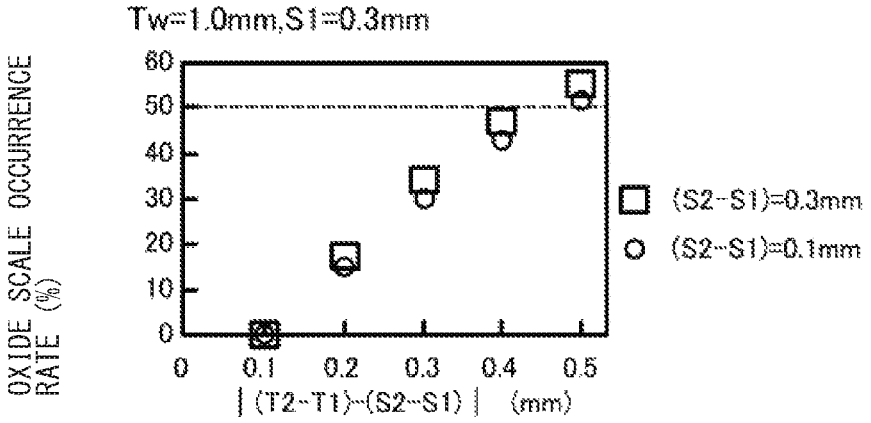
FIGS. 4(A), 4(B) and 4(C) are a set of graphs indicating evaluation results of a third evaluation test.
Figure 4B:
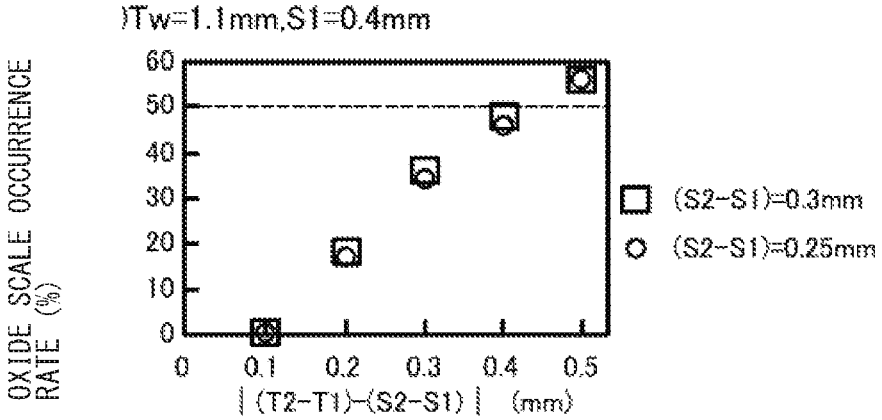
Figure 4C:
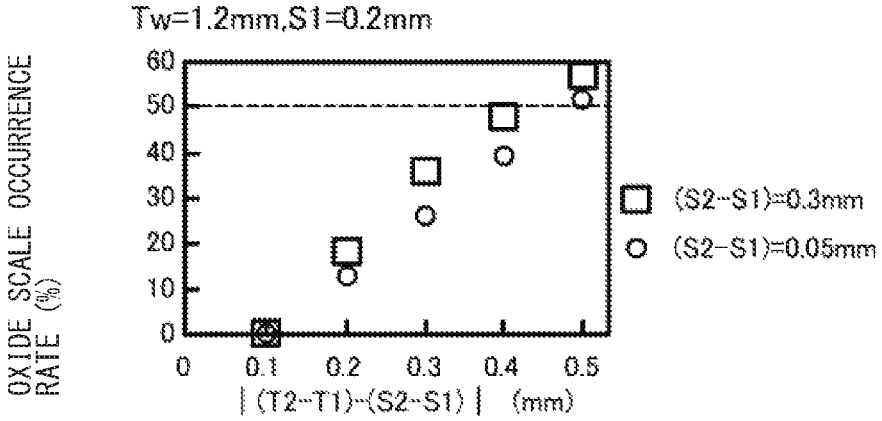

FIGS. 4(A), 4(B) and 4(C) are a set of graphs indicating evaluation results of the third evaluation test. FIG. 4(A) indicates evaluation results (square marks) of the sample group A1 and evaluation results (circle marks) of the sample group A2. FIG. 4(B) indicates evaluation results (square marks) of the sample group B1 and evaluation results (circle marks) of the sample group B2. FIG. 4(C) indicates evaluation results (square marks) of the sample group C1 and evaluation results (circle marks) of the sample group C2.

As indicated in FIGS. 4(A), 4(B) and 6(C), of all the sample groups, the occurrence rate of oxide scale in each sample in which the value of $|(T2-T1)-(S2-S1)|$ was 0.5 mm exceeded 50%. On the other hand, in all the sample groups, the occurrence rate of oxide scale of each sample in which the value of $|(T2-T1)-(S2-S1)|$ was 0.4 mm, 0.3 mm, 0.2 mm, or 0.1 mm was less than 50%. As described above, it has been confirmed that $|(T2-T1)-(S2-S1)|\leq 0.4$ mm is more preferably met in the spark plug 100.

Further, a closer look revealed that in all the sample groups, as the value of $|(T2-T1)-(S2-S1)|$ was decreased, the occurrence rate of oxide scale was decreased substantially in a linear manner. In samples in which $|(T2-T1)-(S2-S1)|$ was 0.1 mm, the occurrence rate of oxide scale was substantially 0%. Therefore, it has been found that as the value of $|(T2-T1)-(S2-S)|$ is decreased, joining strength between the noble metal tip 351 and the intermediate member 353 is remarkably improved. That is, it has been found that in a range that meets $|(T2-T1)-(S2-S1)|\leq 0.4$ mm, $|(T2-T1)-(S2-S1)|$ is preferably smaller. That is, $|(T2-T1)-(S2-S1)|$ is more preferably not more than 0.3 mm, particularly preferably not more than 0.2 mm, and most favorably not more than 0.1 mm.

Figure 5A:
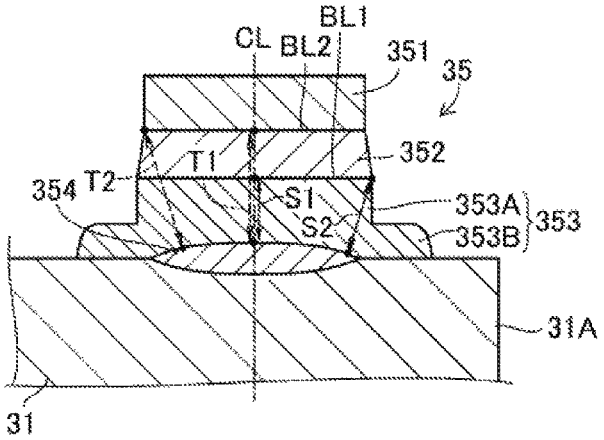
FIGS. 5(A), 5(B) and 5(C) are a set of views illustrating projection portions 35 of modified embodiments.
Figure 5B:
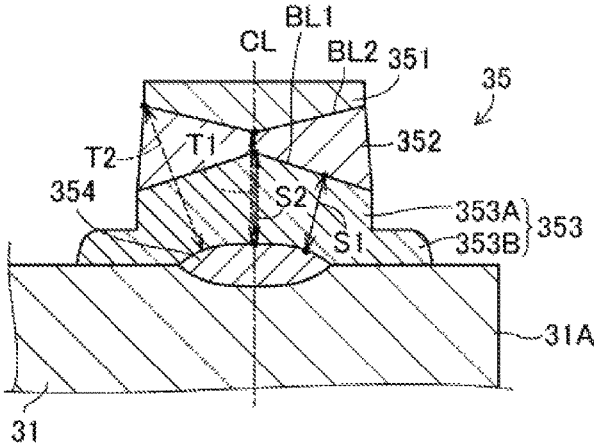
Figure 5C:
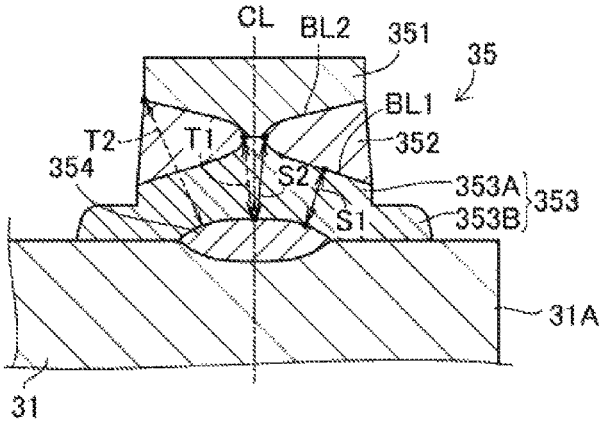

B. Modified Embodiments (1) The projection portion 35 shown in FIG. 2 is an example, and the present invention is not limited thereto. For example, in the projection portion 35, the first melt portion 352 can have not only a shape shown in FIG. 2 but also various shapes. FIGS. 5(A), 5(B) and 5(C) are a set of views illustrating the projection portions 35 of modified embodiments. Since the first melt portion 352 of the projection portion 35 in FIG. 5(A) has little difference between a thickness thereof on the axial line CL and a thickness thereof on the outer peripheral surface, the thickness of the first melt portion 352 is substantially constant regardless of the position in the radial direction. In this example, a point on the boundary BL1 that defines the shortest distance S1 is the intersection point of the boundary BL1 and the axial line CL, and a point on the boundary BL1 that defines the longest distance S2 is the intersection point of the boundary BL1 and the outer peripheral surface. In addition, a point on the boundary BL2 that defines the shortest distance T1 is the intersection point of the boundary BL2 and the axial line CL, and a point on the boundary BL2 that defines the longest distance T2 is the intersection point of the boundary BL2 and the outer peripheral surface.

The first melt portion 352 of the projection portion 35 in FIG. 5(B) is located closer to the rear side as compared with the first melt portion 352 in FIG. 2(B). That is, the first melt portion 352 in FIG. 5(B) is located at a position more distant from the front surface 31S of the ground electrode base material 31. Thus, the position of the first melt portion 352 in the axial direction can be optionally changed.

The first melt portion 352 of the projection portion 35 in FIG. 5(C) is not formed at the position of intersection with the axial line CL. That is, in this example, welding depth of laser welding does not reach the axial line CL. Thus, the first melt portion 352 may not be in contact with the entirety of the front-side surface of the noble metal tip 351, and a part of the front-side surface of the noble metal tip 351 may be in direct contact with the intermediate member 353 without the first melt portion 352 therebetween. In this example, a point on the boundary BL that defines the shortest distance S1 is the point, of the points on the boundary BL1, between the axial line CL and the outer peripheral surface, and a point on the boundary BL1 that defines the longest distance S2 is the point, of the points on the boundary BL1, closest to the axial line CL. In addition, a point on the boundary BL2 that defines the shortest distance T1 is the point closest to the axial line CL, of the points on the boundary BL2, and a point on the boundary BL2 that defines the longest distance T2 is the intersection point of the boundary BL2 and the outer peripheral surface.

(2) In the above-described embodiment, the projection portion 35 is used for the ground electrode 30. However, the projection portion 35 may be used for the center electrode 20. That is, the projection portion 35 may be welded, by resistance welding, to the front end surface of the leg portion 25 (the center electrode base material) of the center electrode 20. That is, the center electrode 20 may include a noble metal tip, an intermediate member, and a center electrode base material, the first melt portion may be formed between the noble metal tip and the intermediate member, and a second melt portion may be formed between the intermediate member and the center electrode base material. Even in this case, in a range of the diameter Tw of an electrode tip that is $1.0\text{ mm}\leq Tw\leq 1.2\text{ mm}$, the shortest distance S1 and the longest distance S2 preferably meet $(S2-S1)\leq 0.3$ mm.

(3) In the above-described embodiment, the ground electrode 30 and the center electrode 20 oppose each other in the direction of the axial line CL of the spark plug 100 so as to form a gap for generating a spark discharge. Instead, the ground electrode 30 and the center electrode 20 may oppose each other in the direction perpendicular to the axial line CL so as to form a gap for generating a spark discharge.

(4) In the general structure of the spark plug 100 of the above-described embodiment, for example, the materials of the metal shell 50, the center electrode 20, the ceramic insulator 10 can be changed variously. In addition, the detailed dimensions of the metal shell 50, the center electrode 20, the ceramic insulator 10 can be changed variously. For example, the material of the metal shell 50 may be low-carbon steel that is plated with zinc or nickel, and may be low-carbon steel that is not plated therewith. In addition, the material of the ceramic insulator 10 may be insulating ceramics other than alumina.

Although the present invention has been described above based on the embodiments and the modified embodiments, the above-described embodiments of the invention are intended to facilitate understanding of the present invention, but not as limiting the present invention. The present invention can be changed and modified without departing from the gist thereof and the scope of the claims and equivalents thereof are encompassed in the present invention.

DESCRIPTION OF REFERENCE NUMERALS

5 . . . gasket,
6 . . . ring member,
8 . . . plate packing,
9 . . . talc.
10 . . . ceramic insulator,
12 . . . through hole,
13 . . . leg portion,
15 . . . step portion,
16 . . . step portion,
17 . . . front trunk portion,
18 . . . rear trunk portion,
19 . . . flange portion,
20 . . . center electrode,
21 . . . center electrode body,
21A . . . electrode base material,
21B . . . core portion,
23 . . . head portion,
24 . . . flange portion,
25 . . . leg portion,
27 . . . melt portion,
29 . . . center electrode tip,
29A . . . discharge surface,
30 . . . ground electrode,
31 . . . ground electrode base material,
31A . . . front end portion,
31B . . . rear end portion,
35 . . . projection portion,
35S . . . front end surface,
40 . . . metal terminal,
41 . . . cap mounting portion,
42 . . . flange portion,
43 . . . leg portion,
50 . . . metal shell,
50A . . . front end surface,
51 . . . tool engagement portion,
52 . . . mounting screw portion,
53 . . . crimp portion,
54 . . . seat portion,
56 . . . step portion,
58 . . . compressive deformation portion,
59 . . . insertion hole,
60 . . . conductive seal,
70 . . . resistor,
80 . . . conductive seal,
100 . . . spark plug,
351 . . . noble metal tip,
351B . . . discharge surface,
352 . . . first melt portion,
353 . . . the intermediate member,
353A . . . body portion,
353B . . . flange portion,
353C . . . protruding portion,
354 . . . second melt portion Having described the invention, the following is claimed:

1. A spark plug comprising a center electrode and a ground electrode, at least one electrode of the center electrode and the ground electrode including:

an electrode base material;

a noble metal tip having a discharge surface in a gap defined between the center electrode and the ground electrode;

an intermediate member that is disposed between the electrode base material and the noble metal tip, the intermediate member including a body portion located at the noble metal tip side and a flange portion having a larger diameter than the body portion and located at the electrode base material side;

a first melt portion that is formed between the body portion of the intermediate member and the noble metal tip; and a second melt portion that is formed, between the flange portion of the intermediate member and the electrode base material, at least at a position of intersection with an axial line of the noble metal tip, wherein in a cross section including the axial line of the noble metal tip, when: a diameter of the noble metal tip is denoted by Tw;

the shortest distance between the second melt portion and a boundary between the first melt portion and the intermediate member is denoted by S1; and the longest distance between the second melt portion and the boundary between the first melt portion and the intermediate member is denoted by S2, $1.0\ \text{mm} \leq Tw \leq 1.2\ \text{mm}$ and $(S2-S1) \leq 0.3\ \text{mm}$ are met.

2. A spark plug according to claim 1, wherein $0.2\ \text{mm} \leq S1 \leq 0.4\ \text{mm}$ is met.

3. A spark plug according to claim 1, wherein in the cross section, when: the shortest distance between the second melt portion and a boundary between the first melt portion and the noble metal tip is denoted by T1; and the longest distance between the second melt portion and the boundary between the first melt portion and the noble metal tip is denoted by T2, $|(T2-T1)-(S2-S1)|(T2-T1)-(S2-S1)| \leq 0.4\ \text{mm}$ is met.

4. A spark plug according to claim 1, wherein the electrode base material and the noble metal tip are a base material and a tip of the ground electrode.

* * * * *